United States Patent [19]

Pintos

[11] 4,100,633

[45] Jul. 18, 1978

[54] COMBINATION SUN SCREEN AND PILLOW

[76] Inventor: Jose Luis Pintos, 1004 Park Plz., Isla Verde, P.R. 00913

[21] Appl. No.: 791,329

[22] Filed: Apr. 27, 1977

[51] Int. Cl.[2] ..... A47G 9/00

[52] U.S. Cl. ..... 5/337; 135/5 R; 297/184

[58] Field of Search ..... 5/344, 337, 317 R; 297/184, 217; 135/5 R

[56] References Cited

U.S. PATENT DOCUMENTS

| | | | |
|---|---|---|---|
| 1,018,522 | 2/1912 | Savage | 135/5 R |
| 2,199,915 | 5/1940 | Howard | 135/5 R |
| 2,428,649 | 10/1947 | Brown | 5/317 R |
| 2,448,734 | 9/1948 | Phillips | 5/317 R |
| 2,561,931 | 7/1951 | Kleiser, Jr. | 5/337 |
| 2,958,769 | 11/1960 | Bounds | 5/337 |

FOREIGN PATENT DOCUMENTS

| | | | |
|---|---|---|---|
| 191,104 | 9/1956 | Austria | 135/5 R |
| 702,896 | 1/1954 | United Kingdom | 135/5 R |

*Primary Examiner*—Paul R. Gilliam
*Assistant Examiner*—Alexander Grosz
*Attorney, Agent, or Firm*—John J. Byrnz; Edward E. Dyson

[57] ABSTRACT

A combination sun screen and pillow for use at the beach, by a swimming pool, or the like. The basic device comprises a pillow, a sun screen, and means mounting the sun screen on the pillow such that, during use of the device, the sun screen shades the face of a person resting his head on the pillow. The mounting means comprises a telescopically extensible rod which is pivotably mounted at one end to the pillow and at the other end to the sun screen, and means are provided on the sun screen for holding a book open and in place on the side of the sun screen adjacent to the pillow. The radio is mounted in or on the pillow, and the pillow contains a closable compartment for the retention of the personal belongings of the person using the device.

1 Claim, 9 Drawing Figures

FIG.4
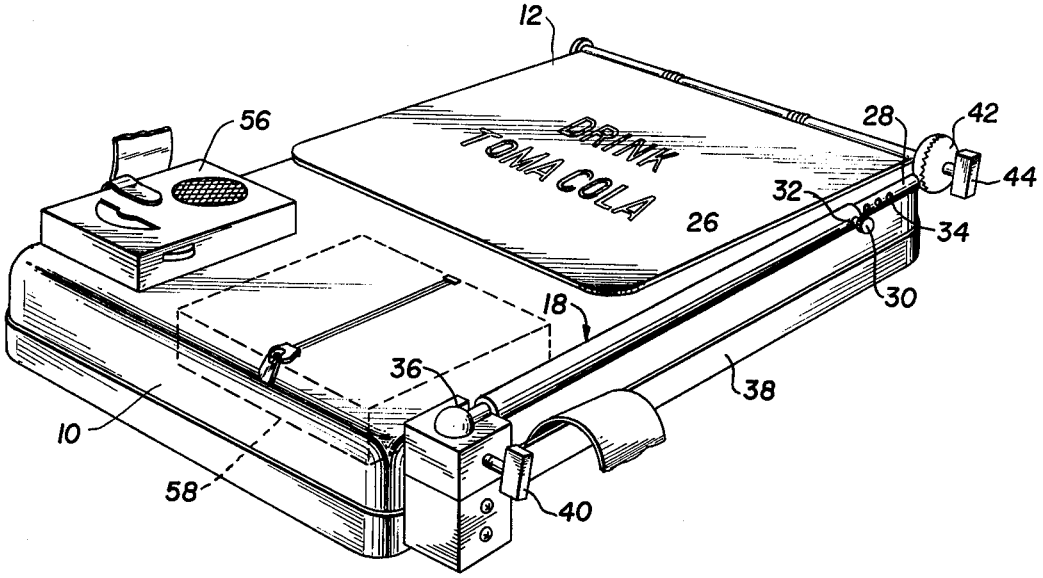
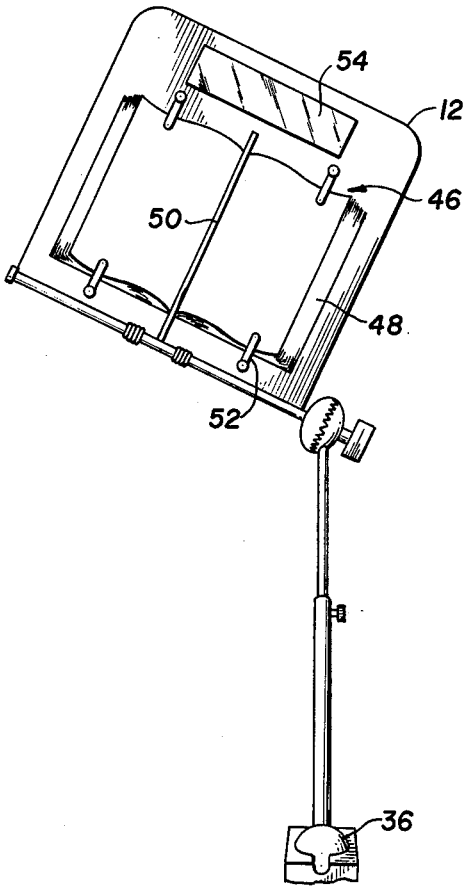
FIG.5

COMBINATION SUN SCREEN AND PILLOW

BACKGROUND OF THE INVENTION

This invention relates to a combination sun screen and pillow for use at the beach, be a swimming pool, or the like. Such devices are known and a representative sample of such devices is shown in U.S. Pat. No. 2,561,931, issued July 28, 1951, to Emil H. Kleiser Jr.

Devices of this general type typically comprise a pillow, a sun screen, and means mounting the sun screen on the pillow such that, during use of the device, the sun screen shades the face of a person resting his head on the pillow. However, while such devices are known theoretically, so far as I know, none has proved a commerical success. I attribute this apparent lack of commercial success to the fact that none of the prior art devices offered enough to the potential customer, and I have designed my invention to overcome this failing.

It is known in the art to provide means for pivoting the sun screen as a whole about a fixed axis on the pillow to raise or lower it relative to the pillow, and it is known to provide means for pivoting the sun screen about a fixed axis through the sun screen in order to vary the orientation of the sun screen relative to the pillow. However, such means do not permit the use of the device to vary the distance between the sun screen and the pillow, which the user may desire to do, particularly when the basic devise is used in conjunction with the book holding means described hereinafter.

While devices comprising the basic pillow, sun screen, and connecting means are known in the art, such devices are an inconvenience to carry around, and the potential customer may well decide that their inconvenience outweights their advantages if the device is simply a combination pillow and sun screen and nothing more.

The problem suggested in the preceeding are not intended to be exhaustive, but rather are among many which tend to reduce the effectiveness of prior combination sun screen and pillow. Other noteworthy problems may also exist; however, those presented above should be sufficient to demonstrate that such devices appearing in the prior art have not been altogether satisfactory.

OBJECTS OF THE INVENTION

It is, therefore, a general object of the invention to provide a combination sun screen and pillow which will obviate or minimize problems of the type previously described.

It is a particular object of the invention to provide such a device which will permit the user to vary the distance between the sun screen and the pillow.

It is a further object of the invention to provide such a device which includes means for holding a book open and in place on the side of the sun screen adjacent to the pillow so that a person resting his head on the pillow can read the book.

It is another object of the invention to provide such a device which includes a radio mounted in or on the pillow.

It is still another object of the invention to provide such a device which includes a closable compartment in the pillow for the retention of the personal belongings of the person using the device.

Other objects and advantages of the present invention will become apparent from the following detailed description of two preferred embodiments thereof taken in conjunction with the accompanying drawings.

THE DRAWINGS

FIG. 4 is a perspective view of a second embodiment of the subject invention in the carrying position.

FIG. 5 is a view of the underside of the sun screen showing a book and a mirror held in place thereon.

DETAILED DESCRIPTION OF THE PRESENTLY PREFERRED EMBODIMENTS

Figure 1:
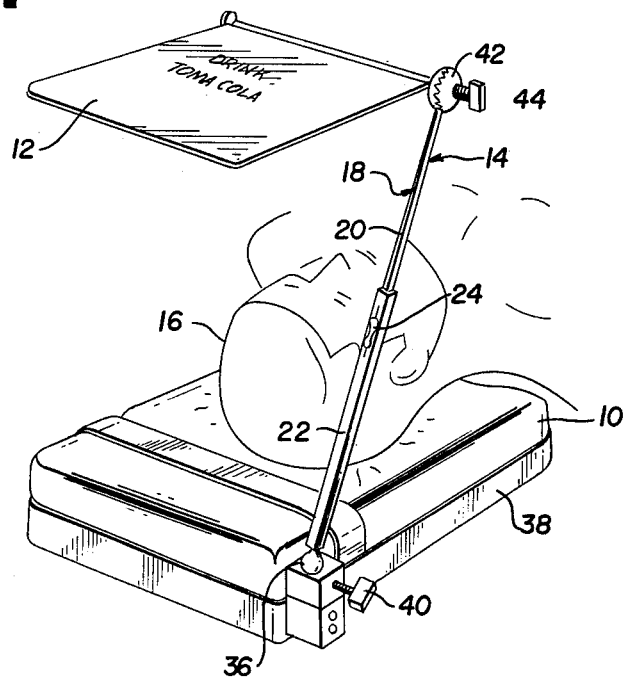
FIG. 1 is a perspective view of a preferred embodiment of the subject invention in use.

Referring now particularly to FIG. 1, there will be seen a combination sun screen and pillow comprising a pillow 10, a sun screen 12, and means 14 mounting the sun screen 12 on the pillow 10 such that the sun screen 12 shades the face of a person 16 resting his head on the pillow 10. The pillow 10 can be made of any appropriate , preferably water-proof material, and it can be solid foam rubber, as shown, or inflatable. The sun screen may be of arbitrary shape and of any appropriate material, so long as it is sufficiently opaque to stop the harmful rays of the sum.

As shown, the means 14 preferably comprises at least one telescopically extensible rod 18 which permits the distance between the pillow 10 and the sun screen 12 to be adjusted. In FIG. 1, the telescopically extensible rod comprises two members 20 and 22 which are square in section and a thumb-operated overcenter device 24 for holding the two members in the desired position, while in FIG. 4 the telescopically extensible rod 18 comprises two members 26, 28 which are round in section and a thumb screw 30 which passes through a clearance hole 32 in the outer member and screws into a selected one of a plurality of spaced threaded holes 34 in the inner member, but obviously many other variations on this theme are possible.

The telescopically extensible rod 18 is pivotably mounted at one end of the pillow 10 and at the other end to the sun screen 12. The end pivotably mounted to the pillow 10 preferably includes one part of a universal joint 36 which permits the rod 18 to be swung both up and down and left and right in order to adjust the orientation of the sun screen 12 relative to the pillow 10. The other part of the universal joint 36 is mounted on a frame 38 which holds the pillow 10, and a thumb screw 40 is provided to lock the universal joint 36 into the desired position. While the end of the rod 18 pivotably mounted to the sun screen 12 also preferably comprises a universal joint in order to permit the sun screen 12 to be swung in any direction relative to the rod 18, it may also, as shown, comprise a simple pivot 42 permitting rotation only about a fixed axis running through or parallel to the surface of the sun screen 12 and a thumb screw 44 provided to lock the pivot 42 into the desired position.

Figure 2A:
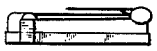
FIGS. 2A–2E are diagrammatic representations showing how the userof the device can control the position of the sun screen relative to the pillow.
Figure 2B:
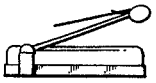
Figure 2C:
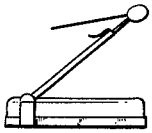
Figure 2D:
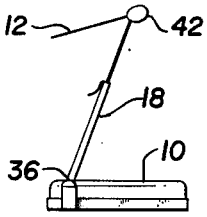
Figure 2E:
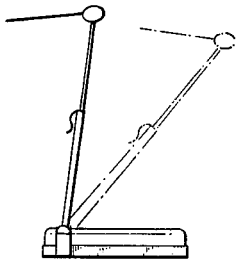
Figure 3:
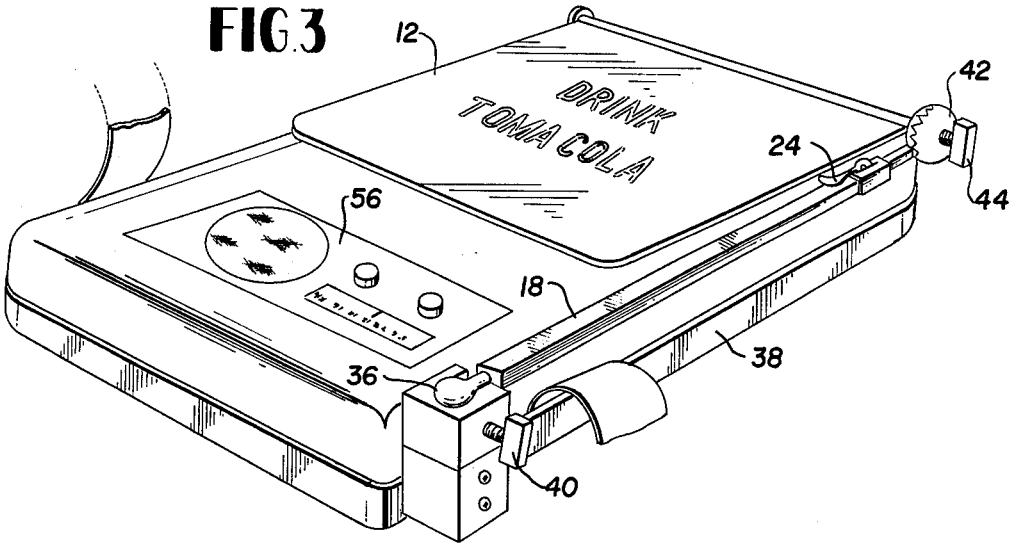
FIG. 3 is a perspective view of a first embodiment of the subject invention in the carrying position.

With the aid of the telescoping ability of the rod 18 and the pivots 36 ad 42, the sun screen 12 can be easily moved from the carrying position shown in FIGS. 2A, 3 and 4 to any of the positions shown in FIGS. 2B through 2E, depending on the desires of the user. In addition, with the aid of the universal joint 36, the sun screen 12 can be pivoted in order to keep it between the user and the sun without the user's having to move.

As shown in FIG. 5, the sun screen 12 preferably comprises means 46 for holding a book 48 open and in place on the side of the sun screen 12 adjacent to the pillow 10, permitting a person resting his head on the pillow to read the book. As shown, the means 48 can comprise a rod 50 pivotably mounted at the base of the sun shield 12 and spring biased towards the surface of the sun shield so as to hold the center of the book against the sun shield and upper and/or lower fingers 52 pivotably mounted on the sun shield 12 and spring biased towards the surface of the sun shield so as to hold the book open, but obviously many arrangements other than the one specifically shown are possible.

Also as shown in FIG. 5, the sun screen 12 preferably comprises a mirror 54 carried on the side of the sun screen 12 adjacent to the pillow 10 so that a person resting his head on the pillow can use the mirror. The mirror 54 can either be permanently affixed to the sun screen 12 or detachably mounted thereon, as by spring clips, so that the user can take it off the sun shield and use it in his (or her) hand.

As shown in FIGS. 3 and 4, a radio 56 is preferably mounted in or on the pillow 10 (using the term "pillow" broadly to encompass both the soft part on which the user actually rests his head and any frame portions which mount the soft part), and, as shown in FIG. 4, the pillow 10 also preferably contains a closable compartment 58 for the retention of the personal belongings (such as cigarettes, car keys, and pocket change) of the person using the device.

As shown in FIGS. 1, 3 and 4, printed matter can be placed on the side of the sun screen remote from the pillow. The printed matter may consist of statements individualizing each devise or, as shown, it can consist of advertizing. The latter would be particularly appropriate where the devices were to be rented out at the beach, and in this case means could be provided for changing the advertising statements at intervals.

ADVANTAGES OF THE INVENTION

From the foregoing description of a combination sun screen and pillow in accordance with some preferred embodiments of the invention, those skilled in the art will recognize several advantages which singularly distinguish the subject invention from previously known devices. Some of those advantages are set forth below. However, while the following list of advantages is believed to be both accurate and representative, it does not purport to be exhaustive.

A particular advantage of the subject invention is that it permits the user of the device to vary the distance between the sun screen and the pillow. This advantage is particularly significant when a book holding means is mounted on the bottom surface of the sun screen to adjust for individual reading distance.

Another significant advantage of the subject invention is that it incorporates in one convenient place one or more other items such as a radio, a container for personal belongings, and a book holder, which the user of the device might otherwise have to carry separately, thereby immensely increasing the utility of the device to its user.

CAVEAT

While the present invention has been illustrated by detailed descriptions of two preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

I claim:

1. In a combination sun screen and pillow comprising:

(a) a pillow;

(b) a sun screen; and (c) first means mounting said sun screen on said pillow such that, in use, said sun screen shades the face of the person resting his head on said pillow, the improvements wherein:

(d) said first means comprises:

(i) at least one telescopically extensible rod whereby the distance between said pillow and said sun screen can be adjusted;

(ii) universal joint means for varying the angle between said pillow and said telescopically extensible rod, whereby said rod can be swung in both directions in the plane of said pillow in order to adjust the orientation of said sun screen relative to said pillow; and (iii) means for varying the angle between said sun screen and said telescopically extensible rod;

(e) said sun screen comprises second means for holding a book open and in place on the side of said sun screen adjacent to said pillow, whereby a person resting his head on said pillow can read the book;

(f) said sun screen comprises a mirror carried on the side of said sun screen adjacent to said pillow, whereby a person resting his head on said pillow can use said mirror;

(g) a radio is mounted in or on said pillow; and (h) said pillow contains a double compartment for the retention of the personal belongings of the person using the device.

* * * * *